US009815475B2

(12) United States Patent
Spata

(10) Patent No.: US 9,815,475 B2
(45) Date of Patent: Nov. 14, 2017

(54) ANALYTICS PLATFORM FOR IDENTIFYING A ROADWAY ANOMALY

(71) Applicant: Accenture Global Solutions Limited, Dublin (IE)

(72) Inventor: Gregory P. Spata, West Chester, OH (US)

(73) Assignee: Accenture Global Solutions Limited, Dublin (IE)

( * ) Notice: Subject to any disclaimer, the term of this patent is extended or adjusted under 35 U.S.C. 154(b) by 80 days.

(21) Appl. No.: 14/950,222

(22) Filed: Nov. 24, 2015

(65) Prior Publication Data

US 2017/0144669 A1 May 25, 2017

(51) Int. Cl.
*B60W 40/06* (2012.01)

(52) U.S. Cl.
CPC ..... *B60W 40/06* (2013.01)

(58) Field of Classification Search
None
See application file for complete search history.

(56) References Cited

U.S. PATENT DOCUMENTS 5,294,210 A * 3/1994 Lemelson ..... B05B 12/122 404/108
5,364,205 A * 11/1994 Lemelson ..... B05B 12/122 404/72
5,803,661 A * 9/1998 Lemelson ..... E01C 23/06 299/41.1
6,429,789 B1 * 8/2002 Kiridena ..... B60R 1/00 340/905
8,180,519 B2 5/2012 Brillhart et al.
8,423,255 B2 4/2013 Padmanabhan et al.
9,626,763 B1 * 4/2017 Hoye ..... G06T 7/0042
2013/0155061 A1 6/2013 Jahanshahi et al.
2014/0196529 A1 7/2014 Cronin et al.
2014/0309930 A1 * 10/2014 Ricci ..... H04W 48/04 701/431
2014/0355839 A1 12/2014 Bridgers et al.
2014/0380264 A1 12/2014 Misra et al.
(Continued)

OTHER PUBLICATIONS

Ray Massey, "Jaguar Land Rover develop car that detects potholes and warns other drivers", The Daily Mail, Jun. 3, 2015, downloaded Jan. 27, 2017 from http://www.dailymail.co.uk/sciencetech/article-3117181/Jaguar-Land-Rover-Develop-car-detects-potholes-wams-drivers.html, pp. 1-8.*

(Continued)

*Primary Examiner* — Russell Frejd
(74) *Attorney, Agent, or Firm* — Harrity & Harrity, LLP

(57) ABSTRACT

An analytics platform may obtain anomaly information associated with a roadway anomaly. The anomaly information may be provided by a sensor system including a sensor array. The analytics platform may determine a set of filters associated with identifying the roadway anomaly as being of a particular type. The analytics platform may apply the set of filters to the anomaly information associated with the roadway anomaly. The analytics platform may identify, based on applying the set of filters to the anomaly information, the roadway anomaly as being of the particular type. The analytics platform may provide, based on identifying the roadway anomaly as being of the particular type, information associated with the roadway anomaly.

20 Claims, 8 Drawing Sheets

(56) References Cited

U.S. PATENT DOCUMENTS

| | | | | |
|---|---|---|---|---|
| 2015/0166072 | A1* | 6/2015 | Powers | B60W 40/06 701/1 |
| 2015/0347478 | A1* | 12/2015 | Tripathi | G06F 17/30241 707/743 |
| 2016/0133130 | A1* | 5/2016 | Grimm | H04L 67/22 340/905 |
| 2016/0221581 | A1* | 8/2016 | Talwar | B60W 40/06 |

OTHER PUBLICATIONS

Eriksson et al., "The Pothole Patrol: Using a Mobile Sensor Network for Road Surface Monitoring", MobiSys'08, Jun. 17-20, 2008, 11 pages.
Chen et al., "CRSM: Crowdsourcing based Road Surface Monitoring", 2013, 8 pages.
De Silva et al., "Automated Pothole Detection Using Wireless Sensor Motes", 2008, 4 pages.
Innis, "Address and Location Capture in Dynamics Crm with Bing Maps", Bing blogs, Jul. 9, 2013, 16 pages.
Rode et al., "Pothole Detection and Warning System using Wireless Sensor Networks", Indian Institute of Technology Hyderabad, 2012, 3 pages.
University of Colombo School of Computing, "Automated Pothole Detection System", Jun. 2, 2010, 1 page.
Yu et al., "Pavement Pothole Detection and Severity Measurement Using Laser Imaging", IEEE, May 2011, 5 pages.

* cited by examiner

ANALYTICS PLATFORM FOR IDENTIFYING A ROADWAY ANOMALY

BACKGROUND

A pothole may include a depression or a hollow in an area of a roadway surface. In some cases, the pothole may be caused by the presence of water in a soil structure underlying the roadway and/or by traffic passing over the affected area.

SUMMARY

According to some possible implementations, a method may include: obtaining, by an analytics platform, anomaly information associated with a roadway anomaly, where the anomaly information may be provided by a sensor system including a sensor array; determining, by the analytics platform, a set of filters associated with identifying the roadway anomaly as being of a particular type; applying, by the analytics platform, the set of filters to the anomaly information associated with the roadway anomaly; identifying, by the analytics platform and based on applying the set of filters to the anomaly information, the roadway anomaly as being of the particular type; and providing, by the analytics platform and based on identifying the roadway anomaly as being of the particular type, information associated with the roadway anomaly.

According to some possible implementations, a device may include one or more processors to: determine anomaly information associated with a roadway anomaly detected by a sensor system; determine one or more filters associated with identifying the roadway anomaly as being of a particular type of roadway anomaly; identify, based on the anomaly information and the one or more filters, the roadway anomaly as being of the particular type; and provide information associated with the roadway anomaly based on identifying the roadway anomaly as being of the particular type.

According to some possible implementations, a non-transitory computer-readable medium may store one or more instructions that, when executed by one or more processors, cause the one or more processors to: determine anomaly information associated with a roadway anomaly; identify one or more filters associated with identifying the roadway anomaly as being of a particular type, where the one or more filters may include a jurisdictional filter associated with confirming that the roadway anomaly is located within an area associated with an entity; identify, based on the anomaly information and the one or more filters, the roadway anomaly as being of the particular type; and provide information associated with the roadway anomaly based on identifying the roadway anomaly as being of the particular type.

DETAILED DESCRIPTION

The following detailed description of example implementations refers to the accompanying drawings. The same reference numbers in different drawings may identify the same or similar elements.

A roadway anomaly, such as a pothole, may be hazardous to vehicles travelling on a roadway. For example, a driver of a vehicle may lose control of the vehicle in the event that a wheel of the vehicle strikes the pothole, which may lead to a collision (e.g., with another vehicle, with an object near the roadway, etc.). Furthermore, striking the pothole may cause damage to the vehicle.

Therefore, it is important to identify the pothole as a particular type of pothole (e.g., a pothole that is to be remedied) in order to inform an entity, associated with repairing the pothole (e.g., a federal organization, a state organization, a county organization, a city organization, a private company charged with maintaining roadways in a particular area, such as a set of particular roadways, a race track, an airport runway, a parking lot, etc.), regarding the pothole.

Implementations, described herein, may allow an analytics platform to identify a pothole as a particular type of pothole based on information detected by a sensor system associated with a vehicle. In some implementations, the analytics platform may identify the pothole as the particular type based on applying one or more analytics filters to anomaly information, associated with the pothole, provided by the sensor system. Implementations, described herein, may also allow the analytics platform to provide information associated with the pothole upon identification of the pothole as being of the particular type (e.g., such that remedial action may be taken).

Notably, while implementations described herein are described in the context of roadway anomalies in the form of potholes, in some implementations, processes and/or methods described herein may apply to one or more other types of roadway anomaly, such as another type of anomaly associated with the roadway surface (e.g., a divot, a sink, a depression, a hollow, a bump, a crack, a rise, a heave, etc.), an anomaly associated with an object located on the roadway surface (e.g., an animal, a piece of trash, a cardboard box, etc.), an anomaly associated with an object near a side of the roadway (e.g., a tree, a mailbox, a sign, etc.), an anomaly associated with an object above the roadway (e.g., a low-hanging tree branch, a powerline, an overpass, etc.), or the like.

Figure 1A:
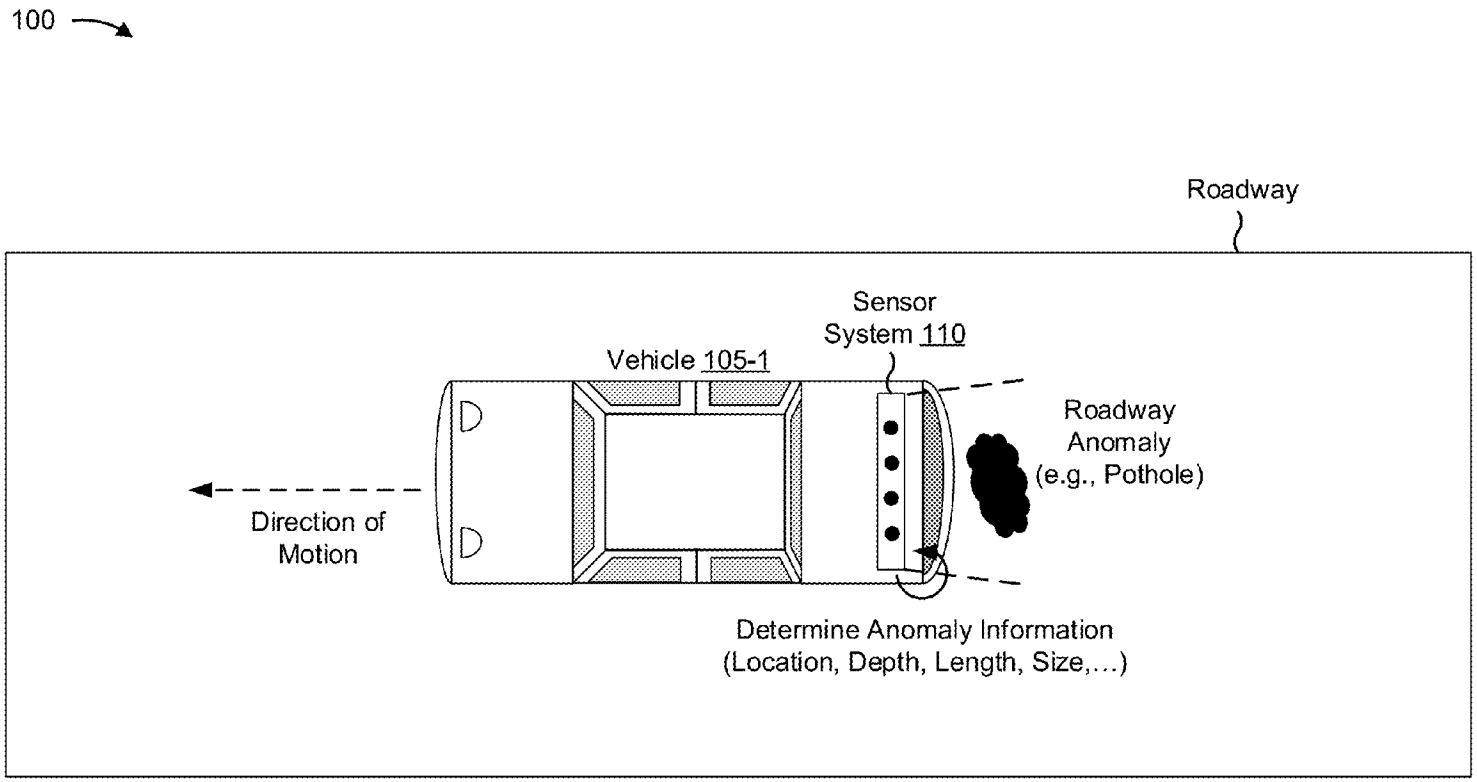
FIGS. 1A-1C are diagrams of an overview of an example implementation described herein.
Figure 1B:
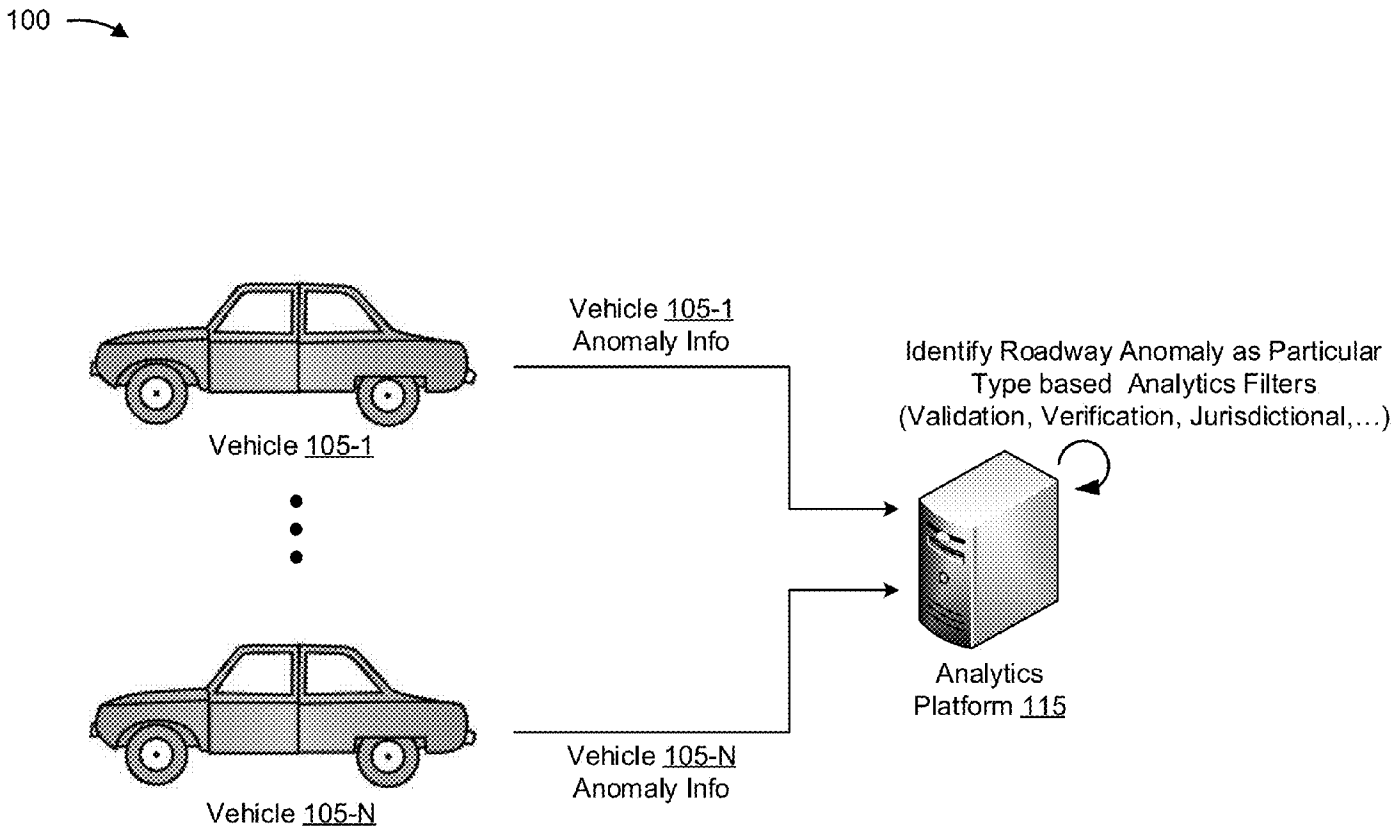
Figure 1C:
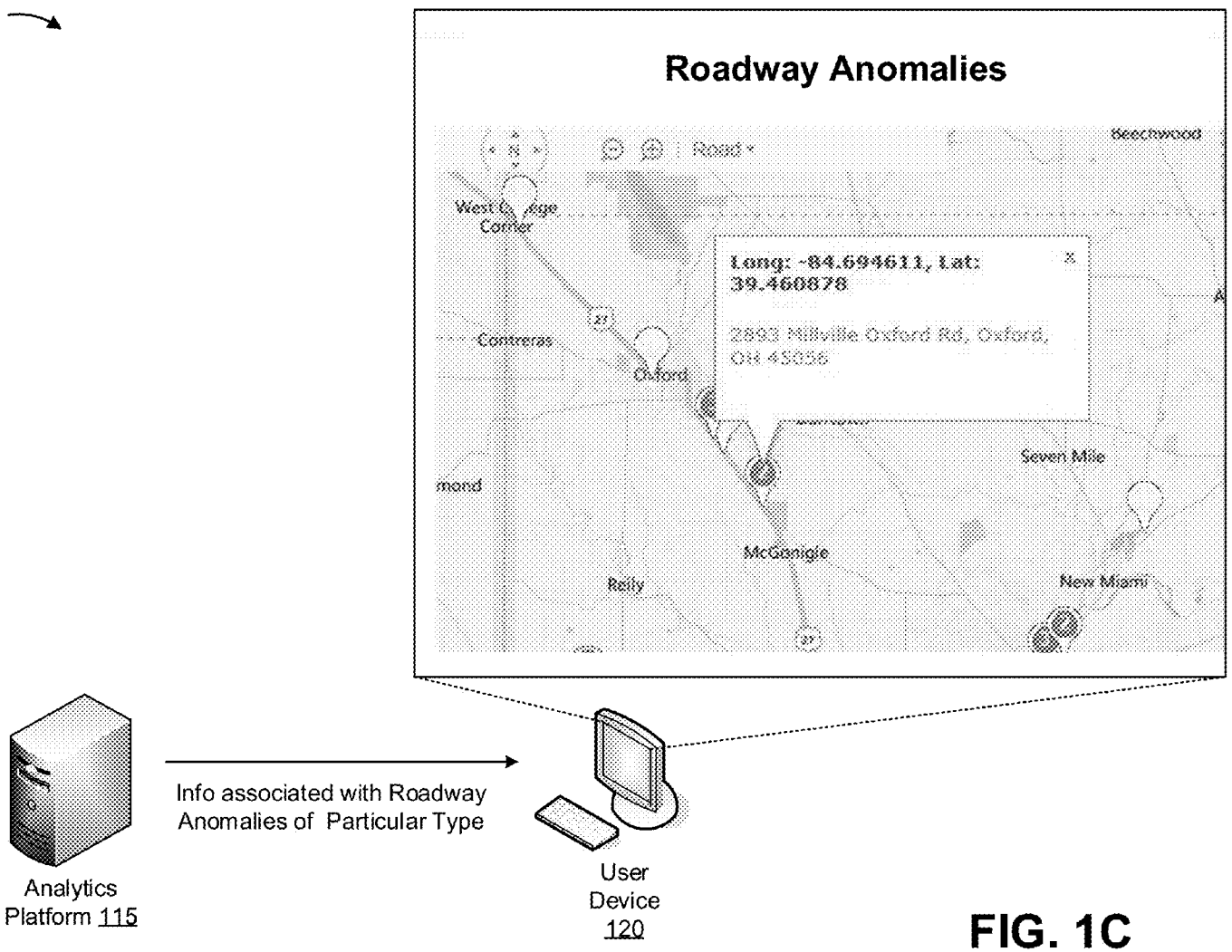

FIGS. 1A-1C are diagrams of an overview of an example implementation 100 described herein. For the purposes of example implementation 100, assume that a sensor system 110 is mounted on a vehicle 105-1 driving on a roadway, and that sensors of sensor system 110 are capable of detecting a pothole based on information determined by the sensors when sensor system 110 passes over the pothole.

As shown, vehicle 105-1 may move in a particular direction such that sensor system 110 passes over a pothole on a surface of the roadway. As shown, based on passing over the pothole, sensor system 110 may detect the pothole. For example, one or more sensors, of sensor system 110, may detect the pothole based on measuring distances from the one or more sensors to the surface of the roadway. Here, the one or more sensors may detect the pothole when the distances measured by the sensors indicate a deviation (e.g., a drop, a rise, etc.) in the roadway at a particular location. As further shown, sensor system 110 may determine anomaly information, associated with the pothole, based on detecting the pothole. For example, sensor system 110 may determine a depth and/or a height of the pothole, a length of the pothole, a size (e.g., small, medium, large, multiple potholes, etc.), a location of the pothole (e.g., a latitude and a longitude, a set of global positioning system (GPS) coordinates), a time associated with detecting the pothole (e.g., a time of day, a date, etc.).

As shown in FIG. 1B, vehicles 105 (e.g., including vehicle 105-1 through vehicle 105-N (N≥1)) may provide anomaly information, associated with potholes detected by vehicles 105, to analytics platform 115 associated with identifying potholes of a particular type, such as potholes that are to be remedied based on depth, length, location, size, or the like. In some implementations, vehicles 105 may automatically provide the anomaly information via a wired and/or a wireless connection (e.g., via a cellular network, a WiFi network, a Bluetooth connection, etc.). Additionally, or alternatively, vehicles 105 may provide the anomaly information using a batch processing technique (e.g., vehicle 105-1 may provide anomaly information, associated with multiple potholes, when vehicle 105-1 is within a range of a WiFi network associated with analytics platform 115). Additionally, or alternatively, vehicles 105 may provide the anomaly information in real-time or near real-time (e.g., via a cellular network when the pothole is detected). In this way, analytics platform 115 may receive anomaly information associated with potholes detected by vehicles 105.

As further shown in FIG. 1B, analytics platform 115 may identify, based on the anomaly information, one or more of the potholes as being of a particular type. The particular type of pothole may include, for example, a pothole for which a remedial action may be undertaken (e.g., by an entity associated with a roadway). In other words, if the pothole is of the particular type, then the pothole may be of concern to and/or should be remedied by the entity associated with the roadway.

In some implementations, analytics platform 115 may identify a pothole as being of the particular type based on applying a set of analytics filters to the anomaly information associated with the pothole, such as a validation filter, a verification filter, a manual filter, a jurisdictional filter, a depth filter, a length filter, a location filter, a size filter, a temporal filter, or the like. In some implementations, the analytics filters may be selected, configured, created, modified, or the like, by a user. In some implementations, analytics platform may identify one or more potholes as being of the particular type based on the anomaly information provided by vehicles 105.

As shown in FIG. 1C, analytics platform 115 may provide, to user device 120, information associated with the one or more potholes identified as being of the particular type. As shown, user device 120 may provide, for display to the user, the information associated with the one or more potholes identified as being of the particular type. For example, as shown, user device 120 may display a map view that includes icons (e.g., a set of markers) at locations corresponding to the one or more potholes. As further shown, the user may select (e.g., by clicking on an icon, by hovering over the icon with a cursor, or the like) a particular pothole, and user device 220 may provide, for display (e.g., in a pop-up window, in a side panel, etc.) additional information associated with the particular pothole.

Additionally, or alternatively, analytics platform 115 may provide information associated with a pothole, identified as being of the particular type, such that a work order, associated with remedying the pothole, is automatically created and/or provided to the entity (e.g., to a maintenance team leader associated with remedying the pothole).

In this way, an analytics platform may identify a pothole as being of a particular type based on information detected by a sensor system mounted on a vehicle. The analytics platform may also provide information associated with the pothole (e.g., such that remedial action may be taken).

Figure 2A:
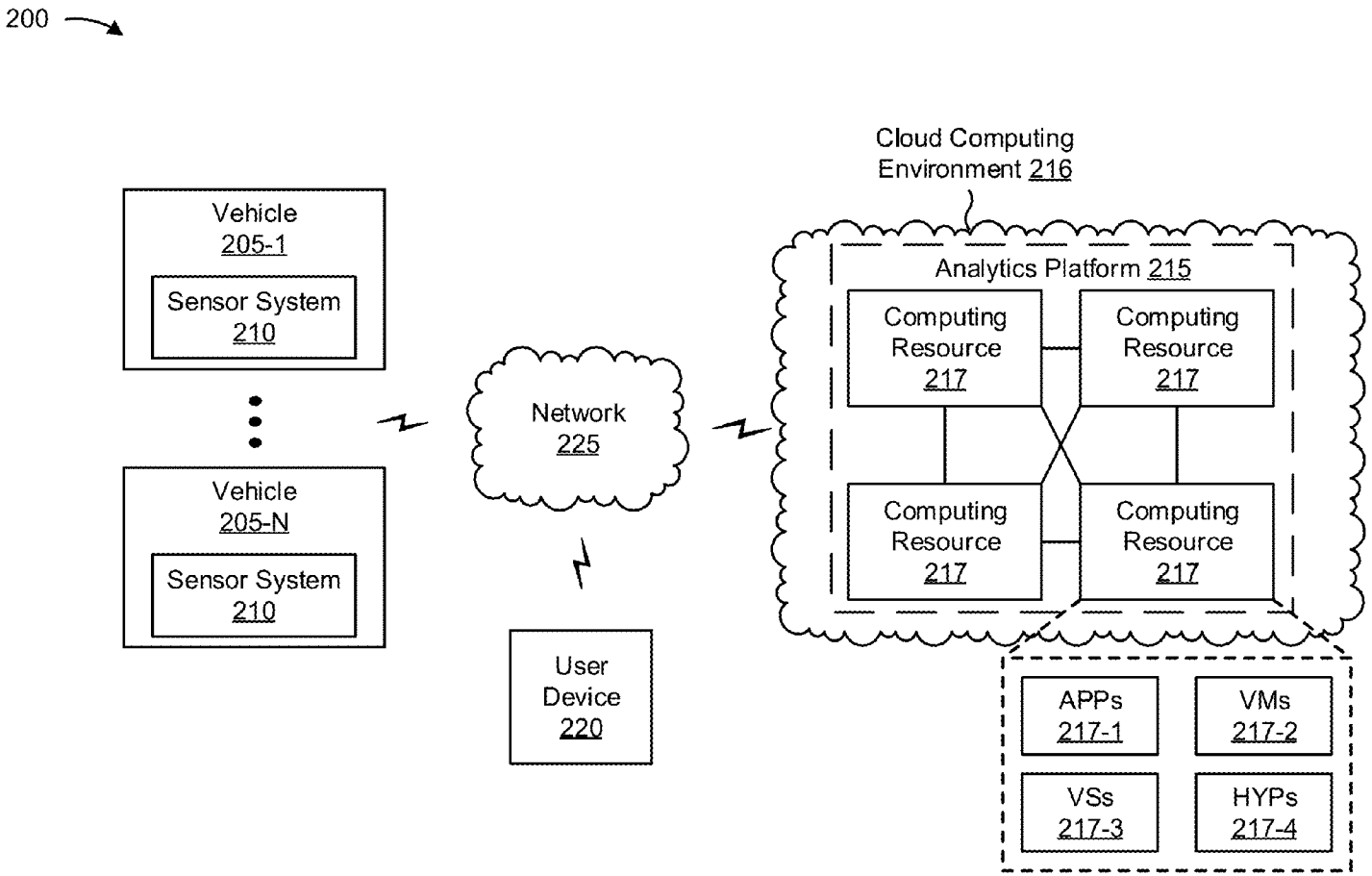
FIGS. 2A and 2B are diagrams of an example environment in which systems and/or methods, described herein, may be implemented.

FIG. 2A is a diagram of an example environment 200 in which systems and/or methods, described herein, may be implemented. As shown in FIG. 2A, environment 200 may include one or more vehicles 205-1 through 205-N (N≥1) (hereinafter referred to collectively as vehicles 205, and individually as vehicle 205) including corresponding sensor system 210, an analytics platform 215 hosted within a cloud computing environment 216, a user device 220, and a network 225. Devices of environment 200 may interconnect via wired connections, wireless connections, or a combination of wired and wireless connections.

Vehicle 205 may include a vehicle, such as an automobile (e.g., a driverless car, a driver controlled car, a bus, a truck, etc.), an airplane (e.g., an unmanned aerial vehicle (UAV), a piloted airplane, a helicopter, etc.), or another type of vehicle on which sensor system 210 may be mounted. In some implementations, vehicle 205 may travel (e.g., drive, fly, etc.) on or over a roadway in order to allow sensor system 210 to determine anomaly information associated with a pothole. In some implementations, vehicle 205 may include a vehicle computer capable of receiving, processing, storing, and/or providing the anomaly information determined by sensor system 210.

Figure 2B:
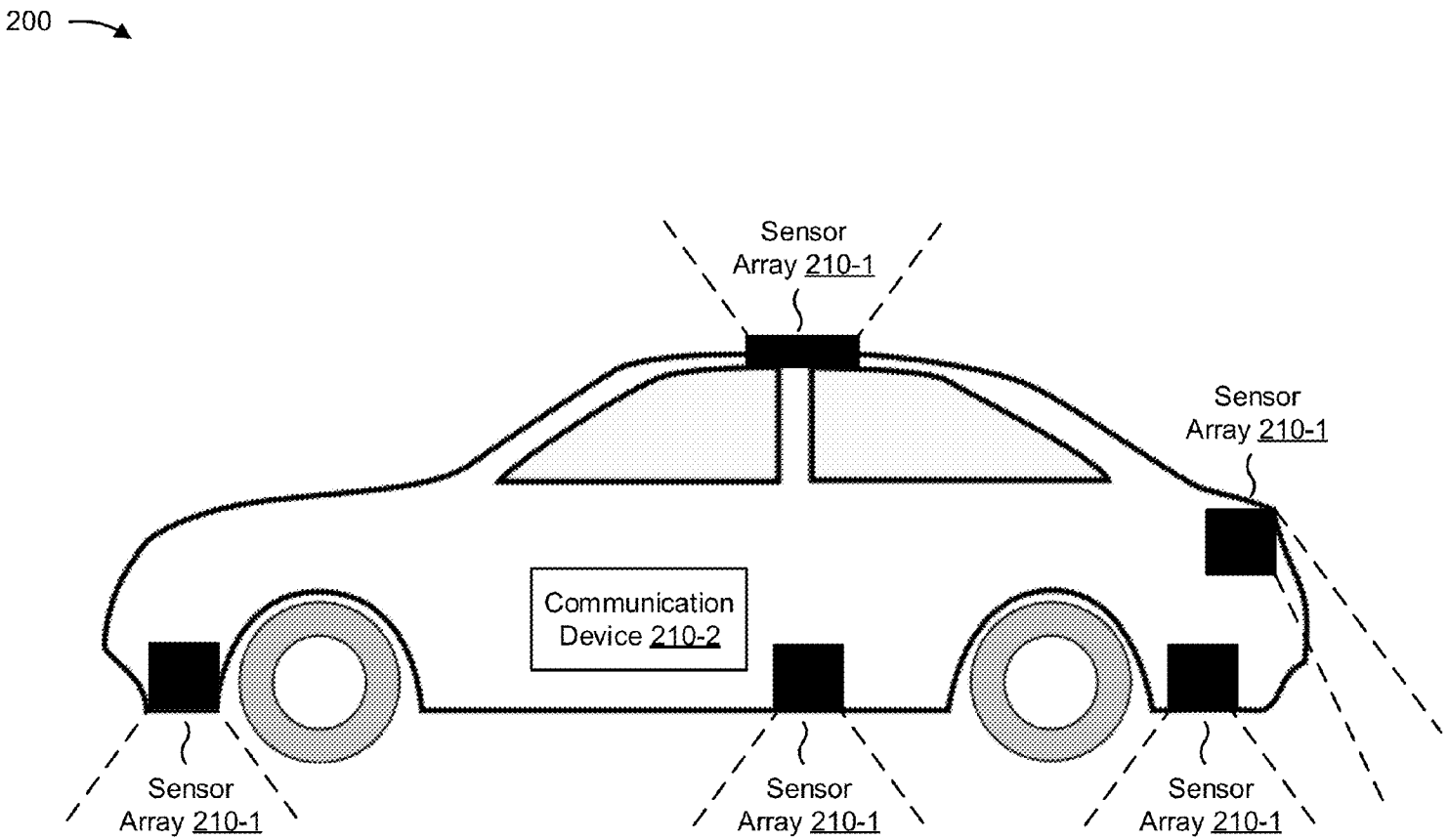

Sensor system 210 may include a system capable of receiving, determining, processing, storing, and/or providing anomaly information associated with a pothole. For example, as shown in FIG. 2B, sensor system 210 may include a set of sensor arrays 210-1 and a communication device 210-2.

Sensor array 210-1 may include one or more sensors capable of detecting a pothole and determining anomaly information associated with the pothole. For example, sensor 210-1 may include a Light Detection and Ranging (LIDAR) laser system, or other type of laser-based system, a radar-based system, an imaging-based system, or a combination of these and/or other types of systems capable of capturing information relating to a pothole. As another example, sensor 210-1 may include an accelerometer (e.g., used to detect the shock of a wheel striking the pothole). In some implementations, sensor system 210 may include multiple sensor arrays 210-1 mounted at one or more locations on vehicle 205 (e.g., a bumper, a grill, a chassis, a roof, a wing, etc.).

Communication device 210-2 may include a device capable of receiving, determining, processing, and/or providing anomaly information associated with a pothole. For example, communication device 210-2 may include a computation and communication device. In some implementations, communication device 210-2 may communicate with other devices (e.g., sensor arrays 210-1, analytics platform 215, etc.) via a wired and/or a wireless connection (e.g., via WiFi, Bluetooth, a cellular network, etc.)

Returning to FIG. 2A, analytics platform 215 may include one or more devices capable of identifying a pothole as being of a particular type of pothole (e.g., based on anomaly information determined by sensor system 210). For example, analytics platform 215 may include a server or a group of servers. In some implementations, analytics platform 215 may be capable of applying one or more analytics filters to the anomaly information in order to identify the pothole as being of a particular type. Additionally, or alternatively, analytics platform 215 may capable of providing information associated with the pothole (e.g., such that a remedial action may be taken).

In some implementations, as shown, analytics platform 215 may be hosted in cloud computing environment 216. Notably, while implementations described herein describe analytics platform 215 as being hosted in cloud computing environment 216, in some implementations, analytics platform 215 may not be cloud-based or may be partially cloud-based.

Cloud computing environment 216 may include an environment that host analytics platform 215. Cloud computing environment 216 may provide computation, software, data access, storage, etc. services that do not require end-user (e.g., user device 220) knowledge of a physical location and configuration of system(s) and/or device(s) that hosts analytics platform 215. As shown, cloud computing environment 216 may include a group of computing resources 217 (referred to collectively as "computing resources 217" and individually as "computing resource 217").

Computing resource 217 may include one or more personal computers, workstation computers, server devices, or another type of computation and/or communication device. In some implementations, computing resource 217 may host analytics platform 215 associated with identifying a particular type of pothole. The cloud resources may include compute instances executing in computing resource 217, storage devices provided in computing resource 217, data transfer devices provided by computing resource 217, etc. In some implementations, computing resource 217 may communicate with other computing resources 217 via wired connections, wireless connections, or a combination of wired and wireless connections.

As further shown in FIG. 2A, computing resource 217 may include a group of cloud resources, such as one or more applications ("APPs") 217-1, one or more virtual machines ("VMs") 217-2, virtualized storage ("VSs") 217-3, one or more hypervisors ("HYPs") 217-4, or the like.

Application 217-1 may include one or more software applications that may be provided to or accessed by user device 220. Application 217-1 may eliminate a need to install and execute the software applications on user device 220. For example, application 217-1 may include software associated with analytics platform 215 and/or any other software capable of being provided via cloud computing environment 216. In some implementations, one application 217-1 may send/receive information to/from one or more other applications 217-1, via virtual machine 217-2.

Virtual machine 217-2 may include a software implementation of a machine (e.g., a computer) that executes programs like a physical machine. Virtual machine 217-2 may be either a system virtual machine or a process virtual machine, depending upon use and degree of correspondence to any real machine by virtual machine 217-2. A system virtual machine may provide a complete system platform that supports execution of a complete operating system ("OS"). A process virtual machine may execute a single program, and may support a single process. In some implementations, virtual machine 217-2 may execute on behalf of a user (e.g., user device 220), and may manage infrastructure of cloud computing environment 216, such as data management, synchronization, or long-duration data transfers.

Virtualized storage 217-3 may include one or more storage systems and/or one or more devices that use virtualization techniques within the storage systems or devices of computing resource 217. In some implementations, within the context of a storage system, types of virtualizations may include block virtualization and file virtualization. Block virtualization may refer to abstraction (or separation) of logical storage from physical storage so that the storage system may be accessed without regard to physical storage or heterogeneous structure. The separation may permit administrators of the storage system flexibility in how the administrators manage storage for end users. File virtualization may eliminate dependencies between data accessed at a file level and a location where files are physically stored. This may enable optimization of storage use, server consolidation, and/or performance of non-disruptive file migrations.

Hypervisor 217-4 may provide hardware virtualization techniques that allow multiple operating systems (e.g., "guest operating systems") to execute concurrently on a host computer, such as computing resource 217. Hypervisor 217-4 may present a virtual operating platform to the guest operating systems, and may manage the execution of the guest operating systems. Multiple instances of a variety of operating systems may share virtualized hardware resources.

User device 220 may include one or more devices capable of receiving, generating, storing, processing, and/or providing information associated with a pothole. For example, user device 220 may include a communication and computing device, such as a mobile phone (e.g., a smart phone, a radiotelephone, etc.), a laptop computer, a desktop computer, a tablet computer, a handheld computer, a wearable communication device (e.g., a smart wristwatch, a pair of smart eyeglasses, etc.), or a similar type of device.

Network 225 may include one or more wired and/or wireless networks. For example, network 225 may include a cellular network (e.g., a long-term evolution (LTE) network, a 3G network, a code division multiple access (CDMA) network, etc.), a public land mobile network (PLMN), a local area network (LAN), a wide area network (WAN), a metropolitan area network (MAN), a telephone network (e.g., the Public Switched Telephone Network (PSTN)), a private network, an ad hoc network, an intranet, the Internet, a fiber optic-based network, or the like, and/or a combination of these or other types of networks.

The number and arrangement of devices and networks shown in FIGS. 2A and 2B are provided as an example. In practice, there may be additional devices and/or networks, fewer devices and/or networks, different devices and/or networks, or differently arranged devices and/or networks than those shown in FIGS. 2A and 2B. Furthermore, two or more devices shown in FIGS. 2A and 2B may be implemented within a single device, or a single device shown in FIGS. 2A and 2B may be implemented as multiple, distributed devices. Additionally, or alternatively, a set of devices (e.g., one or more devices) of environment 200 may perform one or more functions described as being performed by another set of devices of environment 200.

Figure 3:
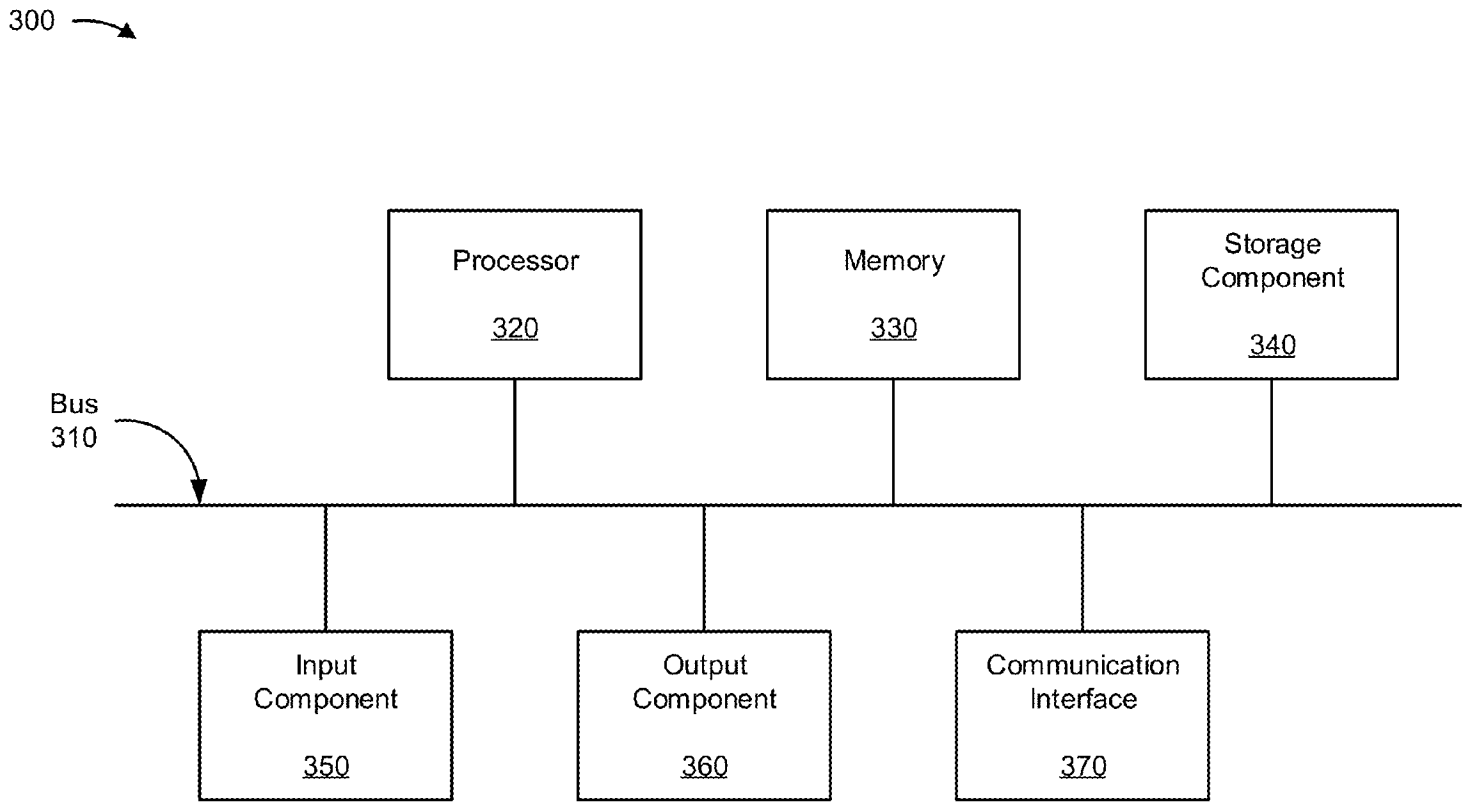
FIG. 3 is a diagram of example components of one or more devices of FIG. 2.

FIG. 3 is a diagram of example components of a device 300. Device 300 may correspond to vehicle 205, sensor system 210, sensor array 210-1, communication device 210-2, analytics platform 215, computing resource 217, and/or user device 220. In some implementations, vehicle 205, sensor system 210, sensor array 210-1, communication device 210-2, analytics platform 215, computing resource 217, and/or user device 220 may include one or more devices 300 and/or one or more components of device 300. As shown in FIG. 3, device 300 may include a bus 310, a processor 320, a memory 330, a storage component 340, an input component 350, an output component 360, and a communication interface 370.

Bus 310 may include a component that permits communication among the components of device 300. Processor 320 is implemented in hardware, firmware, or a combination of hardware and software. Processor 320 may include a processor (e.g., a central processing unit (CPU), a graphics processing unit (GPU), an accelerated processing unit (APU), etc.), a microprocessor, and/or any processing component (e.g., a field-programmable gate array (FPGA), an application-specific integrated circuit (ASIC), etc.) that interprets and/or executes instructions. In some implementations, processor 320 may include one or more processors that can be programmed to perform a function. Memory 330 may include a random access memory (RAM), a read only memory (ROM), and/or another type of dynamic or static storage device (e.g., a flash memory, a magnetic memory, an optical memory, etc.) that stores information and/or instructions for use by processor 320.

Storage component 340 may store information and/or software related to the operation and use of device 300. For example, storage component 340 may include a hard disk (e.g., a magnetic disk, an optical disk, a magneto-optic disk, a solid state disk, etc.), a compact disc (CD), a digital versatile disc (DVD), a floppy disk, a cartridge, a magnetic tape, and/or another type of computer-readable medium, along with a corresponding drive.

Input component 350 may include a component that permits device 300 to receive information, such as via user input (e.g., a touch screen display, a keyboard, a keypad, a mouse, a button, a switch, a microphone, etc.). Additionally, or alternatively, input component 350 may include a sensor for sensing information (e.g., a GPS component, an accelerometer, a gyroscope, an actuator, etc.). Output component 360 may include a component that provides output information from device 300 (e.g., a display, a speaker, one or more light-emitting diodes (LEDs), etc.).

Communication interface 370 may include a transceiver-like component (e.g., a transceiver, a separate receiver and transmitter, etc.) that enables device 300 to communicate with other devices, such as via a wired connection, a wireless connection, or a combination of wired and wireless connections. Communication interface 370 may permit device 300 to receive information from another device and/or provide information to another device. For example, communication interface 370 may include an Ethernet interface, an optical interface, a coaxial interface, an infrared interface, a radio frequency (RF) interface, a universal serial bus (USB) interface, a Wi-Fi interface, a cellular network interface, or the like.

Device 300 may perform one or more processes described herein. Device 300 may perform these processes in response to processor 320 executing software instructions stored by a computer-readable medium, such as memory 330 and/or storage component 340. A computer-readable medium is defined herein as a non-transitory memory device. A memory device includes memory space within a single physical storage device or memory space spread across multiple physical storage devices.

Software instructions may be read into memory 330 and/or storage component 340 from another computer-readable medium or from another device via communication interface 370. When executed, software instructions stored in memory 330 and/or storage component 340 may cause processor 320 to perform one or more processes described herein. Additionally, or alternatively, hardwired circuitry may be used in place of or in combination with software instructions to perform one or more processes described herein. Thus, implementations described herein are not limited to any specific combination of hardware circuitry and software.

The number and arrangement of components shown in FIG. 3 are provided as an example. In practice, device 300 may include additional components, fewer components, different components, or differently arranged components than those shown in FIG. 3. Additionally, or alternatively, a set of components (e.g., one or more components) of device 300 may perform one or more functions described as being performed by another set of components of device 300.

Figure 4:
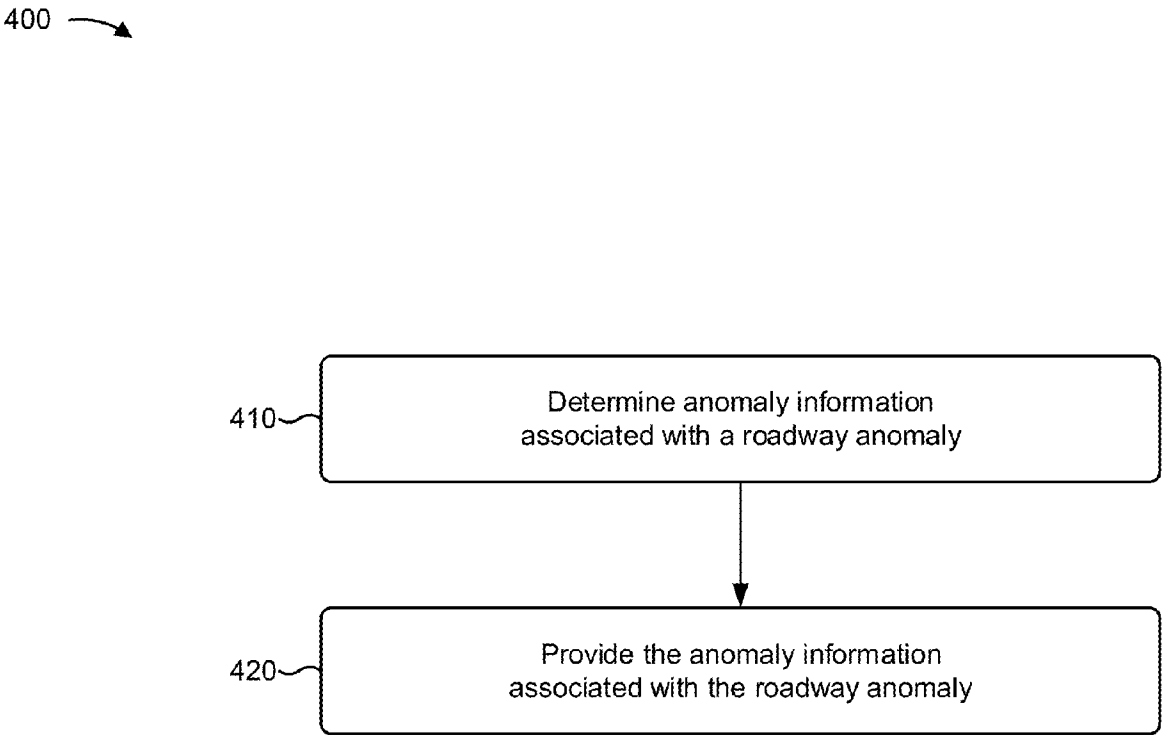
FIG. 4 is a flow chart of an example process for determining and providing anomaly information associated with a roadway anomaly.

FIG. 4 is a flow chart of an example process 400 for determining and providing anomaly information associated with a roadway anomaly. In some implementations, one or more process blocks of FIG. 4 may be performed by sensor system 210. In some implementations, one or more process blocks of FIG. 4 may be performed by another device or a group of devices separate from or including sensor system 210, such as communication device 210-2.

As shown in FIG. 4, process 400 may include determining anomaly information associated with a roadway anomaly (block 410). For example, sensor system 210 may determine anomaly information associated with a pothole. In some implementations, sensor system 210 may determine the anomaly information when (e.g., after, concurrently with, etc.) sensor system 210 passes over the pothole (e.g., when vehicle 205 drives over the pothole, flies over the pothole, etc.) or comes into proximity of the pothole. Additionally, or alternatively, sensor system 210 may determine the anomaly information when sensor system 210 detects the pothole, as described below.

The anomaly information may include information associated with a pothole. For example, the anomaly information may include information that identifies a depth of the pothole, a length of the pothole, a size of the pothole (e.g., small, medium, large, multiple, etc.), a location associated with the pothole (e.g., a latitude and longitude, a set of GPS coordinates, etc.), a time associated with detecting the pothole (e.g., a time of day, a date, etc.), or the like.

In some implementations, sensor system 210 may determine the anomaly information based on detecting the pothole. In some implementations, sensor system 210 may detect the pothole using a baseline distance associated with sensor system 210. For example, sensor array 210-1 of sensor system 210 may be (e.g., automatically, based on user input, etc.) configured with a baseline distance that identifies a (e.g., calibrated) distance from sensor array 210-1 to an intact roadway surface (e.g., a surface of a roadway without a pothole). Here, sensor system 210 may detect the pothole based on sensing deviations from the baseline distance.

For example, sensor array 210-1 of sensor system 210 may periodically (e.g., 100 times per second, 5000 times per minute, etc.) determine a distance to the surface of the roadway, and sensor system 210 may detect the pothole based on comparing the baseline distance and distances determined by sensor array 210-1. As an example, assume that sensor array 210-1 is configured with a baseline distance of 0.30 meters (m). Here, sensor array 210-1 may determine (e.g., as vehicle 205 drives on the roadway) a first distance (e.g., 0.35 m) to the surface of the roadway at a first time and a second distance (e.g., 0.30 m) to the surface of the roadway at a second time.

In this example, sensor system 210 may detect a pothole based on comparing the baseline distance to the first distance and the second distance. For example, sensor system 210 may compare the baseline distance and the first distance, and may detect a pothole since there is a drop (e.g., a negative difference) between the baseline distance and the first distance (e.g., 0.30 m−0.35 m=−0.05 m). Conversely, sensor system 210 may compare the baseline distance and the second distance and may not detect a pothole since there is no difference between the baseline distance and the second distance (e.g., 0.30 m−0.30 m=0.0 m). In this way, sensor system 210 may determine a depth of the pothole (e.g., based on the difference between the baseline distance and the first distance). In some implementations, sensor system 210 may detect the pothole based on averaging multiple consecutive distances determined in succession, such as 3 distances measured in a 0.03 period of time (e.g., in order to account for erroneous distance measurements that may lead to false detections of potholes).

In some implementations, sensor system 210 may detect the pothole when a difference between the baseline distance and a measured distance satisfies a distance threshold. For example, assume that sensor array 210-1 of sensor system 210 is configured with a distance threshold of 0.05 m, indicating that a drop of 0.05 m or more from the baseline distance to a measured distance is indicative of a pothole. Here, if a difference between the baseline distance and a measured distance indicates a drop of 0.06 m (e.g., 0.30 m−0.36 m=−0.06 m), then sensor system 210 may detect a pothole (e.g., since 0.06 m≥0.05 m). Conversely, if a difference between the baseline distance and the distance measured by the sensor of sensor system 210 indicates a drop of 0.01 m (e.g., 0.30 m−0.31 m=−0.01 m) or no change in distance (e.g., 0.30 m−0.30 m=0.00 m), then sensor system 210 may not detect a pothole (e.g., since 0.01 m<0.05 m and 0.00 m<0.05 m, respectively).

In some implementations, sensor system 210 may be configured to determine that a rise (e.g., a positive difference between the baseline distance and a measured distance, such as 0.30 m−0.28 m=0.02 m) is not indicative of a roadway anomaly. Alternatively, sensor system 210 may use a distance threshold (e.g., a same distance threshold as used for a drop, a different distance threshold than used for a drop, etc.) to detect a roadway anomaly associated with a rise. Similarly, sensor system 210 may be configured with a threshold distance associated with another type of roadway anomaly, such as an anomaly associated with an object located on the roadway surface, an anomaly associated with an object near a side of the roadway, an anomaly associated with an object above the roadway, or the like.

In some implementations, sensor system 210 may determine the anomaly information based on distances sensed by multiple sensors of one or more sensor arrays 210-1. For example, assume that sensor array 210-1 of sensor system 210 includes four sensors mounted on a bumper of vehicle 205 (e.g., from left to right: a first sensor, a second sensor, a third sensor, and a fourth sensor). Here, sensor system 210 may determine, based on distances determined by each of the four sensors of sensors array 210-1, anomaly information that identifies a size of the pothole.

For example, if a single sensor (e.g., a first sensor of sensor array 210-1) detects a drop in the roadway surface (e.g., a negative difference between the baseline distance and a distance measured at a first time), and other sensors (e.g., a second sensor, a third sensor, and a fourth sensor of sensor array 210-1) do not detect a drop in the roadway surface (e.g., no difference between the baseline distance and distances measured at the first time), then sensor system 210 may identify the pothole as a small pothole.

As another example, if a pair of adjacent sensors (e.g., the first sensor and the second sensor) detects a drop in the roadway surface, and other sensors (e.g., the third sensor and the fourth sensor) do not detect a drop in the roadway surface, then sensor system 210 may identify the pothole as a medium pothole.

As an additional example, if more than two adjacent sensors (e.g., the first sensor, the second sensor, and the third sensor) detect a drop in the roadway surface, and another sensor (e.g., the fourth sensor) does not detect a drop in the roadway surface, then sensor system 210 may identify the pothole as a large pothole.

As yet another example, if non-adjacent sensors (e.g., the first sensor and the third sensor) detect drops in the roadway surface, and other sensors (e.g., the second sensor and the fourth sensor) do not detect drops in the roadway surface, then sensor system 210 may identify the pothole as multiple potholes (e.g., adjacent small potholes).

In some implementations, sensor system 210 may determine anomaly information that identifies an approximate length of the pothole. For example, a sensor may detect a start (e.g., a first edge) of the pothole when a first measured distance does not indicate a drop, but a second measured distance (e.g., determined immediately after the first measured distance) indicates a drop. Here, the sensor may detect an end of the pothole when a third measured distance (e.g., determined after the second measured distance) indicates a drop, but a fourth measured distance (e.g., determined immediately after the third measured distance), does not indicate a drop. In this example, sensor system 210 may determine the approximate length of the pothole based on a time associated with the second measured distance, a time associated with the third measured distance, and speed information associated with vehicle 205.

In some implementations, sensor system 210 may determine anomaly information that includes a time associated with the pothole. For example, sensor system 210 may determine a time of day, a date, or the like, at which the pothole is detected. Additionally, or alternatively, sensor system 210 may determine anomaly information that identifies a location associated with the pothole. For example, sensor system 210 may determine a latitude and longitude and/or a set of GPS coordinates that identifies a location at which the pothole is detected.

In some implementations, one or more sensors of sensor system 210 may be automatically recalibrated. For example, if one or more sensors of sensor system 210 detects a difference (e.g., a drop or a rise) between the baseline distance and a threshold number of consecutive distance measurements (e.g., 100 consecutive measurements for all sensors, consecutive measurements for a two second time period, etc.), then the one or more sensors may be automatically recalibrated (e.g., to determine a new baseline distance).

As further shown in FIG. 4, process 400 may include providing the anomaly information associated with the roadway anomaly (block 420). For example, sensor system 210 may provide the anomaly information associated with the pothole. In some implementations, sensor system 210 may provide the anomaly information when sensor system 210 determines the anomaly information. Additionally, or alternatively, sensor system 210 may provide the anomaly information when sensor system 210 receives an indication that sensor system 210 is to provide the anomaly information.

As described above, the anomaly information may include information that identifies the depth of the pothole, the length of the pothole, the size of the pothole, the location of the pothole, the time associated with detecting the pothole, and/or any other type of information that may be useful in determining whether an action is to be taken in connection with a pothole or in tracking a pothole.

In some implementations, sensor system 210 (e.g., communication device 210-2) may provide the anomaly information using a batch processing technique. For example, sensor system 210 may provide anomaly information, associated with multiple potholes, to analytics platform 215 via a wireless connection (e.g., via a WiFi network, a Bluetooth connection, etc.) when vehicle 205 is within a range of a wireless LAN (e.g., after vehicle 205 returns from a trip). Here, sensor system 210 may store the anomaly information until vehicle 205 is within the range of the wireless LAN. Additionally, or alternatively, sensor system 210 may provide the anomaly information in real-time or near real-time. For example, sensor system 210 may provide the anomaly information to analytics platform 215 via a cellular network accessible by sensor system 210 when (e.g., immediately after) sensor system 210 determines the anomaly information.

Additionally, or alternatively, sensor system 210 may provide the anomaly information based on a configuration of sensor system 210. For example, sensor system 210 may be configured to provide the anomaly information at a particular time of day (e.g., 12:00 a.m., 2:00 p.m.), at a particular intervals of time (e.g., every Monday, once a day, etc.), or the like. Additionally, or alternatively, sensor system 210 may provide the anomaly information based on a request received (e.g., automatically, based on user input, etc.) from another device, such as analytics platform 215 or user device 220.

Although FIG. 4 shows example blocks of process 400, in some implementations, process 400 may include additional blocks, fewer blocks, different blocks, or differently arranged blocks than those depicted in FIG. 4. Additionally, or alternatively, two or more of the blocks of process 400 may be performed in parallel.

Figure 5:
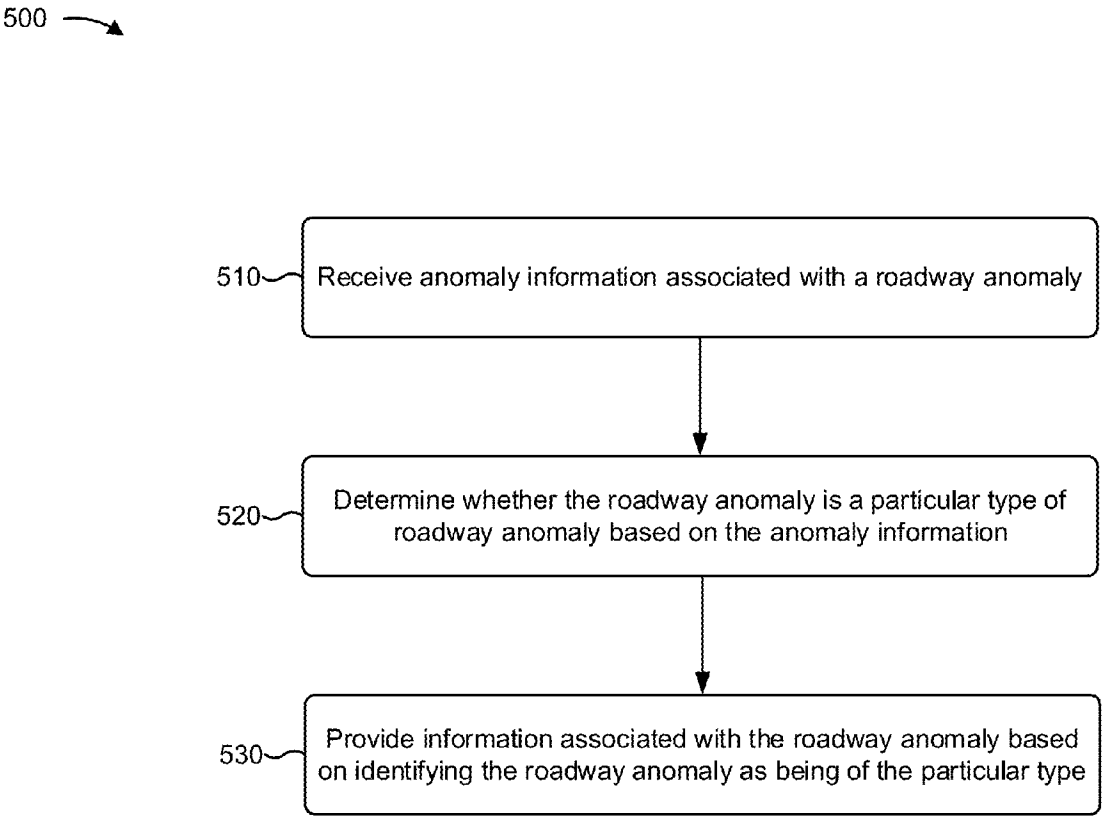
FIG. 5 is a flow chart of an example process for identifying a roadway anomaly as a particular type of roadway anomaly based on anomaly information associated with the roadway anomaly, and providing information associated with the roadway anomaly based on the identification as being of the particular type.

FIG. 5 is a flow chart of an example process 500 for identifying a roadway anomaly as a particular type of roadway anomaly based on anomaly information associated with the roadway anomaly, and providing information associated with the roadway anomaly based on the identification as being of the particular type. In some implementations, one or more process blocks of FIG. 5 may be performed by analytics platform 215. In some implementations, one or more process blocks of FIG. 5 may be performed by another device or a group of devices separate from or including analytics platform 215, such as user device 220.

As shown in FIG. 5, process 500 may include receiving anomaly information associated with a roadway anomaly (block 510). For example, analytics platform 215 may receive anomaly information associated with a pothole. In some implementations, analytics platform 215 may receive the anomaly information when another device provides the anomaly information, such as communication device 210-2 of sensor system 210. Additionally, or alternatively, analytics platform 215 may receive the anomaly information when analytics platform 215 requests the anomaly information (e.g., based on sending a request to sensor system 210). In some implementations, the anomaly information may include information associated with one or more potholes detected by sensor system 210, as described above.

Additionally, or alternatively, analytics platform 215 may receive the anomaly information based on user input. For example, analytics platform 215 may receive user input that includes the anomaly information based on input provided by a user of user device 220, such as a governmental employee, a maintenance team member, a citizen, or the like. In other words, in some implementations, analytics platform 215 may receive manually reported anomaly information. In some implementations, the anomaly information may be manually reported via one or more devices and/or applications, such as a user device, a web portal, a crowd-sourced application, or the like.

As further shown in FIG. 5, process 500 may include determining whether the roadway anomaly is a particular type of roadway anomaly based on the anomaly information (block 520). For example, analytics platform 215 may determine whether the pothole is a particular type of pothole based on the anomaly information (herein sometimes referred to as "identifying the pothole as a particular type of roadway anomaly based on the anomaly information"). In some implementations, analytics platform 215 may identify the pothole as being of the particular type when analytics platform 215 receives the anomaly information. Additionally, or alternatively, analytics platform 215 may identify the pothole as being of the particular type when analytics platform 215 receives an indication that analytics platform 215 is to identify potholes of the particular type, such as an indication based on a configuration of analytics platform 215, based on user input, or the like.

The particular type of pothole may include a pothole for which a remedial action may be undertaken (e.g., by an entity associated with a roadway). In other words, the particular type of pothole may include a pothole that may be of concern to and/or is to be remedied by the entity associated with the roadway. In some implementations, analytics platform 215 may identify the pothole as being of the particular type based on applying a set of analytics filters to the anomaly information associated with the pothole, such as a validation filter, a verification filter, a manual filter, a jurisdictional filter, or the like.

The validation filter may include a filter associated with determining that the pothole is located on particular type of roadway. For example, the validation filter may include a filter associated with determining that the pothole is located on a paved roadway (e.g., rather than an unpaved roadway, a gravel roadway, a dirt roadway, etc.), a public roadway (e.g., rather than a privately-owned roadway), or the like.

In some implementations, analytics platform 215 may apply the validation filter based on performing a reverse geocode lookup. For example, analytics platform 215 may determine a location (e.g., a latitude and longitude, a set of GPS coordinates, etc.) of the pothole based on the anomaly information. Analytics platform 215 may then determine (e.g., based on information stored or accessible by analytics platform 215) geocode data associated with the location. The geocode data may include information that identifies a type of roadway at the location. Analytics platform 215 may then determine, based on the geocode data and the location of the pothole, whether the pothole is located on the particular type of roadway (e.g., on a paved road, on a public roadway, etc.). If the pothole is not on the particular type of roadway (e.g., not on a paved roadway, not on a public roadway, etc.), then analytics platform 215 may not identify the pothole as being of the particular type (i.e., the pothole may not pass the validation filter). Alternatively, if the pothole is on the particular type of roadway (e.g., on paved roadway, on a public roadway, etc.), then analytics platform 215 may identify the pothole as being of the particular type (e.g., assuming that the pothole passes all other applied analytics filters).

The verification filter may include a filter associated with verifying the pothole based on multiple detections. For example, the verification filter may include a filter that allows a pothole to be identified as being of the particular type when the pothole has been detected multiple times (e.g., once by different sensor systems 210, multiple times by a same sensor system 210, etc.).

In some implementations, analytics platform 215 may apply the verification filter based on a location associated with the pothole. For example, analytics platform 215 may determine the location of the pothole based on the anomaly information. Analytics platform 215 may then compare the location of the pothole to locations, associated with other potholes, stored by analytics platform 215 (e.g., received at an earlier time). Here, if the location of the pothole matches (e.g., exactly, within a threshold distance, such as 0.5 m, 1.1 m, etc.) a location associated with another pothole, then analytics platform 215 may increment a verification counter, associated with the location of the pothole, that identifies a number of times the pothole has been detected. In this example, when the verification counter satisfies a threshold (e.g., two detections, three detections, etc.), analytics platform 215 may identify the pothole as being of the particular type (e.g., assuming that the pothole passes all other analytics filters). In some implementations, the verification counter threshold may be user configurable.

Alternatively, if the location of the pothole does not match a location associated with another pothole, then analytics platform 215 may not identify the pothole as being of the particular type. In this case, analytics platform 215 may start a verification counter (e.g., at a value of 1), associated with the location, such that analytics platform 215 may match the location, associated with the pothole, to another location, associated with another pothole, received at a later time. In some implementations, analytics platform 215 may delete the information associated with the pothole (e.g., the verification counter, the anomaly information, etc.), if the pothole is not verified within a threshold amount of time (e.g., one month, 45 days, etc.).

The manual filter may include a filter associated with identifying a pothole as being of the particular type based on user-provided information. For example, the manual filter may include a filter that prevents a pothole from being identified as being of the particular type based on input indicating that the pothole is to be ignored, such as when the user indicates (e.g., via user device 220) that a sunken manhole cover is at the location associated with the pothole, that a speed bump is at the location associated with the pothole, or the like. As another example, the manual filter may include a filter that prevents a pothole from being identified as being of the particular type based on user input indicating that the pothole has been remedied, such as when the user indicates that the pothole has been repaired. In some implementations, analytics platform 215 may store information associated with remedied potholes (e.g., such that a user may view the information associated with the remedied potholes at a later time).

The jurisdictional filter may include a filter associated with confirming that the pothole is located within an area for which an entity is charged with remedying potholes. For example, in the case of a federal organization, the jurisdictional filter may cause analytics platform 215 to identify a pothole as being of the particular type when the pothole is located on a federal highway, a parking lot of a federal building, or the like. As another example, in the case of a state organization, the jurisdictional filter may cause analytics platform 215 to identify a pothole as being of the particular type when the pothole is located on a state highway, within borders of a state, or the like. As another example, in the case of a city organization, the jurisdictional filter may cause analytics platform 215 to identify a pothole as being of the particular type when the pothole is located within city limits and at a location that is not on a federal highway, a state highway, a county road, privately maintained, or the like. As such, in some implementations, the jurisdictional filter may be associated with a geographic area, such as an area corresponding to city limits, county borders, state borders, an interstate highway, or the like.

In some implementations, analytics platform 215 may apply the jurisdictional filter based on the location associated with the pothole. For example, analytics platform 215 may determine the location of the pothole based on the anomaly information. Analytics platform 215 may then determine (e.g., based on user provided information, based on geocode data, etc.) jurisdictional information that describes areas within the jurisdiction of the entity and, based on the jurisdictional information, may determine whether the pothole is located within the jurisdiction of the entity. If the location of the pothole is not within an area under the jurisdiction of the entity, then analytics platform 215 may not identify the pothole as being of the particular type (i.e., the pothole may not pass the jurisdictional filter). Alternatively, if the pothole is within an area under the jurisdiction of the entity, then analytics platform 215 may identify the pothole as being of the particular type (e.g., assuming that the pothole passes all other applied analytics filters).

In some implementations, analytics platform 215 may apply one or more other analytics filters to the anomaly information when identifying the pothole as being of the particular type. For example, analytics platform 215 may apply a depth filter that causes analytics platform 215 to identify a pothole as being of the particular type when a depth of the pothole satisfies a threshold (e.g., 0.05 m, 0.10 m, etc.).

As another example, analytics platform 215 may apply a size filter that causes analytics platform 215 to identify a pothole as being of the particular type when a size of the pothole satisfies a threshold (e.g., at least a medium size, at least a large size, only multiple potholes, etc.).

As another example, analytics platform 215 may apply a length filter that causes analytics platform 215 to identify a pothole as being of the particular type when a length of the pothole satisfies a threshold (e.g., at least 0.20 m long, between 0.50 m and 1.0 m long, etc.).

As yet another example, analytics platform 215 may apply a location filter that causes analytics platform 215 to identify a pothole as being of the particular type when a location of the pothole is within a particular area (e.g., within a particular square kilometer, within a circular area centered at a particular location, etc.). In some implementations, analytics platform 215 may determine location information, associated with the pothole, and may process the location information before applying the location filter. For example, analytics platform 215 may determine a latitude and longitude associated with the pothole, and may reduce (e.g., by rounding) significant figures associated with the latitude and longitude before applying the location filter. In some implementations, processing the location information may account for variations associated with measuring the location information (e.g., minor variations in GPS results).

As still another example, analytics platform 215 may apply a temporal filter that causes analytics platform 215 to identify a pothole as being of the particular type when a time associated with the pothole satisfies a threshold (e.g., when the pothole was detected within the last seven days, was detected no more than 30 days ago, etc.).

In some implementations, analytics platform 215 may apply one or more analytics filters to the anomaly information. For example, analytics platform 215 may apply the verification filter, the validation filter, the manual filter, and the jurisdictional filter to the anomaly information in order to identify the pothole as being of the particular type. In such a case, the pothole may be identified as being of the particular type when the pothole passes each of the verification filter, the validation filter, the manual filter, and the jurisdictional filter.

In some implementations, analytics platform 215 may receive information associated with the one or more analytics filters (e.g., information that identifies analytics filters to be applied by analytics platform 215, information that defines parameters and/or configurations of an analytics filter, etc.) based on information provided by another device, such as user device 220. Additionally, or alternatively, analytics platform 215 may determine the information associated with the one or more analytics filters based on user input. For example, a user may provide user input associated with creating, configuring, editing, modifying, selecting, or the like, the one or more analytics filters to be applied by analytics platform 215. Additionally, or alternatively, analytics platform 215 may determine the information associated with the one or more analytics filters based on a default configuration of analytics platform 215.

In some implementations, analytics platform 215 may monitor the pothole and/or make a prediction associated with the pothole when analytics platform 215 does not identify the pothole as being of the particular type. For example, assume that analytics platform 215 determines that a pothole is not of the particular type based on applying a depth filter to anomaly information associated with the pothole (e.g., when the pothole is only 0.05 m and a depth threshold is 0.10 m). Here, analytics platform 215 may store the anomaly information, and the anomaly information may be updated upon a second detection of the pothole. In this example, analytics platform 215 may monitor and/or track the depth of the pothole.

Furthermore, in some implementations, analytics platform 215 may use historical anomaly information (e.g., associated with other potholes) to predict when the pothole may become the particular type of pothole (e.g., analytics platform 215 may predict a date when the pothole will reach a depth of 0.10 m). This may allow analytics platform 215 to provide information associated with potential future potholes of the particular type such that the entity may act accordingly (e.g., undertake a proactive measure, hire additional maintenance workers, etc.).

As further shown in FIG. 5, process 500 may include providing information associated with the roadway anomaly based on identifying the roadway anomaly as being of the particular type (block 530). For example, analytics platform 215 may provide information associated with the pothole based on identifying the pothole as being of the particular type. In some implementations, analytics platform 215 may provide the information associated with the pothole after analytics platform 215 identifies the pothole as being of the particular type (e.g., after analytics platform 215 applies one or more analytics filters to the anomaly information associated with the pothole). Additionally, or alternatively, analytics platform 215 may provide the information associated with the pothole when analytics platform 215 receives an indication that analytics platform 215 is to provide information associated with potholes of the particular type from another device, such as user device 220.

In some implementations, the information associated with the pothole may include the anomaly information associated with the pothole, such as information that identifies the location of the pothole, the depth of the pothole, the length of the pothole, the time associated with the pothole, and/or other information that may be useful in taking an action in relation to the pothole.

In some implementations, analytics platform 215 may provide the information associated with the pothole for display to a user. For example, analytics platform 215 may provide the information associated with the pothole to user device 220. Here, user device 220 may display the information associated with the pothole. For example, user device 220 may display a map view that includes an icon (e.g., a marker, a flag, etc.) at a location of the pothole. In some implementations, analytics platform 215 may provide information associated with multiple potholes (e.g., multiple potholes identified as being of the particular type), and the map view, displayed by user device 220, may include icons corresponding to the multiple potholes.

In some implementations, the icon may indicate a severity and/or importance associated with the pothole. For example, if the depth of the pothole satisfies a danger threshold (e.g., 10 cm deep or more), then user device 220 may display an icon with a first characteristic (e.g., a red color). Alternatively, if the depth does not satisfy the danger threshold, then user device 220 may display an icon with a second characteristic (e.g., a yellow color).

As another example, if the pothole is located on a high priority roadway (e.g., a roadway on which hazardous materials may be transported, a high traffic roadway, etc.), then user device 220 may display an icon with the first characteristic. Alternatively, if the pothole is located on a low priority roadway (e.g., a roadway on which hazardous materials may not be transported, a low traffic roadway, etc.), then user device 220 may display an icon with the second characteristic. In some implementations, analytics platform 215 may provide, to user device 220, information indicate which characteristic is to be associated with the icon corresponding to the pothole. In other words, analytics platform 215 may determine (e.g., based on information stored or accessible by analytics platform 215) how the icon is to be displayed, and may provide an indication to user device 220, accordingly.

In some implementations, the user may select, via the map view, the pothole (e.g., by clicking the icon, by hovering over the icon with a cursor, etc.), and user device 220 may display (e.g., on the map view, in a pop-up window, within a side panel, etc.) additional information associated with the pothole, such as the depth, the length, the size, the time, or the like. In some implementations, user device 220 may modify the map view based on user input. For example, the user may pan and/or zoom across the map view, and user device 220 may update the display accordingly.

In some implementations, analytics platform 215 may provide updated pothole information. For example, user device 220 may receive user input associated with updating (e.g., removing, editing, modifying, etc.) one or more analytics filters applied by analytics platform 215. Here, user device 220 may provide information associated with updating the one or more analytics filters to analytics platform 215, and analytics platform 215 may re-identify potholes of the particular type based on updating the one or more analytics filters (e.g., identify additional potholes as being of the particular type, determine that potholes previously identified as being of the particular type are no longer of the particular type, etc.). Analytics platform 215 may then provide updated pothole information, and user device 220 may display the information, accordingly.

In some implementations, analytics platform 215 may provide the information associated with the pothole such that a work order, associated with remedying the pothole, is automatically (e.g., without user intervention) created and/or provided to the entity (e.g., to maintenance team leader associated with repairing the pothole). For example, assume that analytics platform 215 identifies a pothole as being of the particular type. Here, analytics platform 215 may automatically create a work order that includes information associated with the location of the pothole, the length of the pothole, the size of the pothole, or the like. Analytics platform 215 may then provide, the work order associated with the pothole (e.g., such that the maintenance team leader may view the work order). In some implementations, analytics platform 215 may provide the work order via an email, a text message (e.g., a short message service (SMS) message), a roadway maintenance platform, a workforce management application, a physical document (e.g., a paper document), or the like. In some implementations, the work order may include the type and/or amount of material needed to repair the pothole.

In some implementations, analytics platform 215 may provide the information associated with the pothole to a user device 220 in vehicle 205. In this way, a driver of vehicle 205 can be provided with information for navigating around the pothole. In some implementations, analytics platform 215 may provide the information associated with the pothole to communication device 210-2 of vehicle 205. In this way, the information associated with the pothole could be displayed in a navigation system associated with vehicle 205. In the case of vehicle 205 being a driverless car, vehicle 205 can automatically adjust navigation based on the information associated with the pothole.

In some implementations, analytics platform 215 may determine and provide reporting information (e.g., associated with the entity). The reporting information may include information associated with unresolved potholes (e.g., a number of unresolved potholes resolved, a percentage of unresolved potholes, a rate of unresolved potholes, etc.), resolved potholes (e.g., a number of potholes resolved, a percentage of potholes resolved, a rate of potholes resolved, etc.), cost information associated with resolving potholes (e.g., a total cost, a per pothole cost, etc.), or the like.

In some implementations, analytics platform 215 may apply a gamification technique when providing the reporting information (e.g., in order to motivate the entity to improve pothole resolution). For example, analytics platform 215 may provide information associated with a comparison between current reporting information, associated with the entity, and historical reporting associated with the entity (e.g., a year-to-year comparison, a month-to-month comparison, etc.). As another example, analytics platform 215 may provide information associated with a comparison between current reporting information, associated with the entity, and current and/or historical reporting associated with another entity (e.g., a jurisdiction of a similar size, a jurisdiction with a similar number of potholes, etc.).

Although FIG. 5 shows example blocks of process 500, in some implementations, process 500 may include additional blocks, fewer blocks, different blocks, or differently arranged blocks than those depicted in FIG. 5. Additionally, or alternatively, two or more of the blocks of process 500 may be performed in parallel.

Implementations, described herein, may allow an analytics platform to identify a pothole as a particular type of pothole based on information detected by a sensor system associated with a vehicle. In some implementations, the analytics platform may identify the pothole as the particular type based on applying one or more analytics filters to anomaly information, associated with the pothole, provided by the sensor system. Implementations, described herein, may also allow the analytics platform to provide information associated with the pothole upon identification the pothole as being of the particular type (e.g., such that remedial action may be taken).

As used herein, the term component is intended to be broadly construed as hardware, firmware, and/or a combination of hardware and software.

Some implementations are described herein in connection with thresholds. As used herein, satisfying a threshold may refer to a value being greater than the threshold, more than the threshold, higher than the threshold, greater than or equal to the threshold, less than the threshold, fewer than the threshold, lower than the threshold, less than or equal to the threshold, equal to the threshold, etc.

Certain-user interfaces have been described herein and/or shown in the figures. A user interface may include a graphical user interface, a non-graphical user interface, a text-based user interface, etc. A user interface may provide information for display. In some implementations, a user may interact with the information, such as by providing input via an input component of a device that provides the user interface for display. In some implementations, a user interface may be configurable by a device and/or a user (e.g., a user may change the size of the user interface, information provided via the user interface, a position of information provided via the user interface, etc.). Additionally, or alternatively, a user interface may be pre-configured to a standard configuration, a specific configuration based on a type of device on which the user interface is displayed, and/or a set of configurations based on capabilities and/or specifications associated with a device on which the user interface is displayed.

It will be apparent that systems and/or methods, described herein, may be implemented in different forms of hardware, firmware, or a combination of hardware and software. The actual specialized control hardware or software code used to implement these systems and/or methods is not limiting of the implementations. Thus, the operation and behavior of the systems and/or methods were described herein without reference to specific software code—it being understood that software and hardware can be designed to implement the systems and/or methods based on the description herein.

Even though particular combinations of features are recited in the claims and/or disclosed in the specification, these combinations are not intended to limit the disclosure of possible implementations. In fact, many of these features may be combined in ways not specifically recited in the claims and/or disclosed in the specification. Although each dependent claim listed below may directly depend on only one claim, the disclosure of possible implementations includes each dependent claim in combination with every other claim in the claim set.

No element, act, or instruction used herein should be construed as critical or essential unless explicitly described as such. Also, as used herein, the articles "a" and "an" are intended to include one or more items, and may be used interchangeably with "one or more." Furthermore, as used herein, the terms "group" and "set" are intended to include one or more items (e.g., related items, unrelated items, a combination of related and unrelated items, etc.), and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A method, comprising:

obtaining, by an analytics platform, anomaly information associated with a roadway anomaly, the anomaly information being provided by a sensor system including a sensor array;

determining, by the analytics platform, a set of filters associated with identifying the roadway anomaly as being of a particular type;

applying, by the analytics platform, the set of filters to the anomaly information associated with the roadway anomaly;

identifying, by the analytics platform and based on applying the set of filters to the anomaly information, the roadway anomaly as being of the particular type, the set of filters including a size filter that causes the analytics platform to identify the roadway anomaly as being of the particular type based on a size of the roadway anomaly, the roadway anomaly being identified as:

first-sized based on a drop in a roadway surface being detected by a single sensor of the sensor array, second-sized, greater than the first-sized, based on the drop in the roadway surface being detected by a pair of adjacent sensors of the sensor array, or third-sized, greater than the second-sized, based on the drop in the roadway surface being detected by more than two adjacent sensors, of the sensor array; and providing, by the analytics platform and for display, information associated with the roadway anomaly based on identifying the roadway anomaly as being of the particular type, a first icon being used based on the size of the roadway anomaly satisfying a threshold, or a second icon being used based on the size of the roadway anomaly not satisfying the threshold.

2. The method of claim 1, where the set of filters includes a validation filter associated with determining that the roadway anomaly is located on particular type of roadway.

3. The method of claim 1, where the set of filters includes a verification filter associated with verifying the roadway anomaly based on multiple detections of the roadway anomaly.

4. The method of claim 1, where providing the information associated with the roadway anomaly comprises:

causing the anomaly information, associated with the roadway anomaly, to be displayed via a user device.

5. The method of claim 1, where the sensor system is mounted on or installed in a vehicle.

6. The method of claim 1, where the sensor system includes at least one of:

a Light Detection And Ranging (LIDAR) laser system;

a radar-based system; or an imaging-based system.

7. The method of claim 1, where the set of filters includes at least one of:

a depth filter that identifies a threshold depth;

a length filter that identifies a threshold length;

a location filter that identifies a geographic area; or a temporal filter that identifies a particular time.

8. A device, comprising:

one or more processors to:

determine anomaly information associated with a roadway anomaly detected by a sensor system;

determine one or more filters associated with identifying the roadway anomaly as being of a particular type of roadway anomaly;

identify, based on the anomaly information and the one or more filters, the roadway anomaly as being of the particular type, the one or more filters including a size filter that causes an analytics platform to identify the roadway anomaly as being of the particular type based on a size of the roadway anomaly, the roadway anomaly being identified as:

first-sized based on a drop in a roadway surface being detected by a single sensor of the sensor system, second-sized, greater than the first-sized, based on the drop in the roadway surface being detected by a pair of adjacent sensors of the sensor system, or third-sized, greater than the second-sized, based on the drop in the roadway surface being detected by more than two adjacent sensors, of the sensor system; and provide, for display, information associated with the roadway anomaly based on identifying the roadway anomaly as being of the particular type, a first icon being used based on the size of the roadway anomaly satisfying a threshold, or a second icon being used based on the size of the roadway anomaly not satisfying the threshold.

9. The device of claim 8, where the one or more filters include a manual filter associated with user-provided information corresponding to the roadway anomaly.

10. The device of claim 8, where the one or more filters include a jurisdictional filter associated with confirming that the roadway anomaly is located within an area associated with an entity.

11. The device of claim 8, where the one or more processors, when providing the information associated with the roadway anomaly, are to:

cause a work order, associated with remedying the roadway anomaly, to be provided, the work order being provided without user intervention, and the work order including the information associated with the roadway anomaly.

12. The device of claim 8, where the sensor system is mounted on or installed in a vehicle.

13. The device of claim 8, where the one or more processors, when determining the one or more filters, are to:

determine the one or more filters based on user input.

14. The device of claim 8, where the one or more filters include at least one of:

a depth filter that identifies a threshold depth;
a length filter that identifies a threshold length;
a location filter that identifies a geographic area; or
a temporal filter that identifies a particular time.

15. A non-transitory computer-readable medium storing instructions, the instructions comprising:

one or more instructions that, when executed by one or more processors, cause the one or more processors to:

determine anomaly information associated with a roadway anomaly;

identify one or more filters associated with identifying the roadway anomaly as being of a particular type, the one or more filters including a jurisdictional filter associated with confirming that the roadway anomaly is located within an area associated with an entity, and the one or more filters including a size filter that causes an analytics platform to identify the roadway anomaly as being of the particular type based on a size of the roadway anomaly, the roadway anomaly being identified as:

first-sized based on a drop in a roadway surface being detected by a single sensor, second-sized, greater than the first-sized, based on the drop in the roadway surface being detected by a pair of adjacent sensors, or third-sized, greater than the second-sized, based on the drop in the roadway surface being detected by more than two adjacent sensors;

identify, based on the anomaly information and the one or more filters, the roadway anomaly as being of the particular type; and provide, for display, information associated with the roadway anomaly based on identifying the roadway anomaly as being of the particular type, a first icon being used based on the size of the roadway anomaly satisfying a threshold, or a second icon being used based on the size of the roadway anomaly not satisfying the threshold.

16. The non-transitory computer-readable medium of claim 15, where the one or more filters include a validation filter associated with determining that the roadway anomaly is located on particular type of roadway.

17. The non-transitory computer-readable medium of claim 15, where the one or more filters include a verification filter associated with verifying the roadway anomaly based on multiple detections of the roadway anomaly.

18. The non-transitory computer-readable medium of claim 15, where the one or more filters include a manual filter associated with user-provided information corresponding to the roadway anomaly.

19. The non-transitory computer-readable medium of claim 15, where the one or more instructions, that cause the one or more processors to provide the information associated with the roadway anomaly, cause the one or more processors to:

generate a work order associated with remedying the roadway anomaly, the work order being provided without user intervention, and the work order including the information associated with the roadway anomaly.

20. The non-transitory computer-readable medium of claim 15, where the one or more instructions, that cause the one or more processors to determine the anomaly information, cause the one or more processors to:

determine the anomaly information from a sensor system mounted on or installed in a vehicle.

* * * * *